US005168726A

United States Patent [19]

York

[11] Patent Number: 5,168,726

[45] Date of Patent: Dec. 8, 1992

[54] CENTRIFUGAL REFRIGERATION SYSTEM

[76] Inventor: Charles L. York, 212 N. Elder, Broken Arrow, Okla. 74012

[21] Appl. No.: 747,934

[22] Filed: Aug. 21, 1991

[51] Int. Cl.[5] ..... F25B 3/00

[52] U.S. Cl. ..... 62/499; 165/86

[58] Field of Search ..... 62/499; 165/86

[56] References Cited

U.S. PATENT DOCUMENTS

| | | | |
|---|---|---|---|
| 3,726,107 | 4/1973 | Hintze | 62/499 |
| 3,948,061 | 4/1976 | Kidwell | 62/499 |
| 4,077,230 | 3/1978 | Eskeli | 62/499 |

*Primary Examiner*—Ronald C. Capossela
*Attorney, Agent, or Firm*—Head & Johnson

[57] ABSTRACT

An improved centrifugal refrigeration system having an elongated rotatably supported shaft with means to rotate the shaft, a condenser unit affixed to and rotated with the shaft, the condenser unit having a tubular member coiled about the shaft in a path beginning at a condenser unit inlet point at a first radius from the shaft and increasing as it is coiled about the shaft to an outlet point at a greater radius, an evaporator unit affixed to and rotated by the shaft and being spaced from the condenser unit, the evaporator unit having a tubular member coiled about the shaft in a path beginning with an inlet point adjacent the shaft and an outlet point at a second radius from the shaft, the second radius of the evaporator unit outlet point being less than or at least not substantially greater than the first radius of the condenser inlet point, a refrigeration return line connecting the evaporator outlet point to the condenser outlet point, a refrigerant delivery tube connecting the condenser outlet point to the evaporator inlet point, a metering device interposed in the refrigerant delivery tube, and refrigerant filling the condenser tubing, evaporator tubing, refrigeration return tube and refrigeration delivery tube in a closed hermetically sealed system. As the shaft is rotated the refrigerant is compressed in the condenser unit by centrifugal force into a liquid, the liquid passing through the metering device and into the evaporator unit where the liquid expands into gas, absorbing heat and the refrigerant gas is returned back to the condenser inlet point in a continuous cycle.

9 Claims, 3 Drawing Sheets

CENTRIFUGAL REFRIGERATION SYSTEM

BACKGROUND INFORMATION

The most common refrigeration system in use in the world today employs a refrigerant that is changeable from a liquid to a vapor phase and in which the refrigerant is compressed from a vapor into a liquid, the liquid refrigerant being increased in temperature as a result of the transformation, the liquid being cooled and conveyed to an evaporator unit wherein the liquid undergoes a pressure drop and is transformed from essentially a liquid to a vapor phase, absorbing heat. The characteristics of liquids to heat upon transformation from a vapor phase to the liquid phase and to absorb heat upon transformation form a liquid to a vapor phase is utilized in refrigeration systems for refrigerators, freezers and for air conditioning buildings, automobiles, and so forth. The cooling of a closed space is achieved by passing air over a evaporator within or in communication with the closed space and heat is dissipated to the environment by passing air over a heat exchanger containing heated liquid refrigerant in a position outside of the closed space to be cooled.

A typical refrigeration system in use today employs a compressor driven by a prime mover. The most commonly used compressor employs an electric motor and in the preferred arrangement for most refrigeration systems, particularly those of a relatively small capacity such as for a refrigerator, air conditioner for a home or so forth, the electric motor and compressor are hermetically sealed as a part of the total refrigeration system. The typical refrigeration system for automobiles, large buildings, and so forth utilizes a compressor driven by a primer mover mounted externally of the closed refrigerant system.

Whether the prime mover is hermetically sealed within the system or is external of the system, a compressor employs moving parts that must be lubricated. For this reason, any refrigeration system employing a compressor typically includes lubricant mixed with the refrigerant.

The present disclosure is an improved centrifugal refrigeration unit that does not employ any type of compression system wherein one part moves against another within the confines of the closed refrigerant system. This features eliminates the need for lubricant within the hermetically sealed refrigerant circulation system.

Reference is made to U.S. Pat. No. 3,948,061 entitled "Centrifugal Refrigeration Unit", issued Apr. 6, 1976, which describes a refrigeration system in which the refrigerant circulation system does not have any parts which move against each other. The present disclosure is an improvement to the basic concept of the centrifugal refrigerant unit of U.S. Pat. No. 3,948,061 by the provision of a critical relationship between the diameter of an evaporator unit coil relative to the diameter of a condenser unit coil, both coils being rotated about a common shaft, as described in detail in the following description of the preferred embodiments.

SUMMARY OF THE INVENTION

The present disclosure is an improved centrifugal refrigeration system. The system includes an elongated rotatably supported shaft having opposed first and second ends and having an axis of rotation. The shaft can be hollow or solid, however, a solid shaft is preferred since, in the system of this disclosure, it is not necessary to conduct fluid or gas flow through the interior of the shaft.

A means is provided to rotate the shaft. This may, by example, be achieved by a primer mover, such as a motor, having a shaft extending therefrom. A sheave is affixed to the prime mover shaft and another sheave is attached to the refrigeration system shaft. By means of a belt the prime mover then rotates the refrigeration system shaft. It can be seen that the refrigeration system shaft can be directly coupled to the shaft of a prime mover.

A condenser unit is affixed to the shaft adjacent one end thereof and is rotated with the shaft. The condenser unit has a tubing member coiled about the shaft in a path beginning at a condenser unit inlet point that is spaced at a selected radius "A" from the axis of rotation from the shaft. The tubular member coils in increasing diameter about the shaft to a condenser unit outlet point at a radius "B" spaced from the axis of rotation, the radius being greater than radius "B".

An evaporator unit is affixed to the shaft adjacent the second end and is rotated with the shaft. The evaporator unit has a tubing member that is coiled about the shaft in a path beginning with an evaporator unit inlet point at a selected radius "D" from the axis of rotation of the shaft and increases in radius as it is coiled about the shaft to an evaporator unit outlet point at a radius "C" from the shaft.

The condenser unit and evaporator unit are physically arranged so that the radius "C", that is, the radius of the outlet point of the evaporator unit, is less than or at least not substantially greater than the radius "A", that is, the radius of the inlet point of the condenser unit.

A refrigerant return tube connects the evaporator outlet point to the condenser inlet point, and a refrigerant delivery tube connects the condenser unit outlet point to the evaporator unit inlet point.

A metering device is interposed in the refrigerant delivery tube, preferably spaced in close proximity to the condenser unit outlet point.

The tubing members of the condenser unit and evaporator unit, the refrigerant return tube and the refrigerant delivery tube and the metering device are all connected together in a hermetically sealed unit. Within such hermetically sealed unit there are not parts that move against each other.

The entire hermetically sealed system is filled with a refrigerant. The quantity of refrigerant is selected such that under operating conditions a refrigerant is in two phases, that is, a liquid phase and a vapor phase.

The refrigeration system functions by the rotation of the shaft. The centrifugal force applied by such rotation causes refrigerant, and particularly the liquid phase of the refrigerant, to migrate outwardly to compress within the condenser unit. The compressed liquid refrigerant passes from the condenser unit through the metering device wherein the pressure is dropped. The reduced pressure refrigerant is passed by the refrigerant delivery tube to the evaporator unit wherein it expands from a liquid to a gas, absorbing heat. The gas is then passed from the evaporator unit through the refrigerant return tube back to the inlet point of the condenser unit.

The evaporator unit and the condenser unit are spaced apart from each other and are arranged such that the evaporator unit may be positioned within a confined area for cooling action and in like manner, the condenser unit may be positioned in a confined area for heating action. When the system is utilized for refrigeration the heat generated by the condensation of refrigerant from the vapor to liquid phase in the condenser unit can be passed to the atmosphere. However, if the refrigeration system is for heating rather than cooling proposes, the heat that is generated by the condenser unit can be utilized.

A better understanding of the improved centrifugal refrigeration system of this disclosure will be had by reference to the following description and claims, taken in conjunction with the attached drawings.

DESCRIPTION OF THE DRAWINGS

The basic improved centrifugal refrigeration system is illustrated in FIG. 1 in an elevational view showing a rotatable shaft supporting a condenser unit on the right end of the shaft and an evaporator unit on the left end of the shaft with a prime mover and belt system used for rotation of the shaft.

FIG. 3 shows the employment of fan blades as an integral part of the condenser unit.

DESCRIPTION OF THE PREFERRED EMBODIMENT

Figure 1:
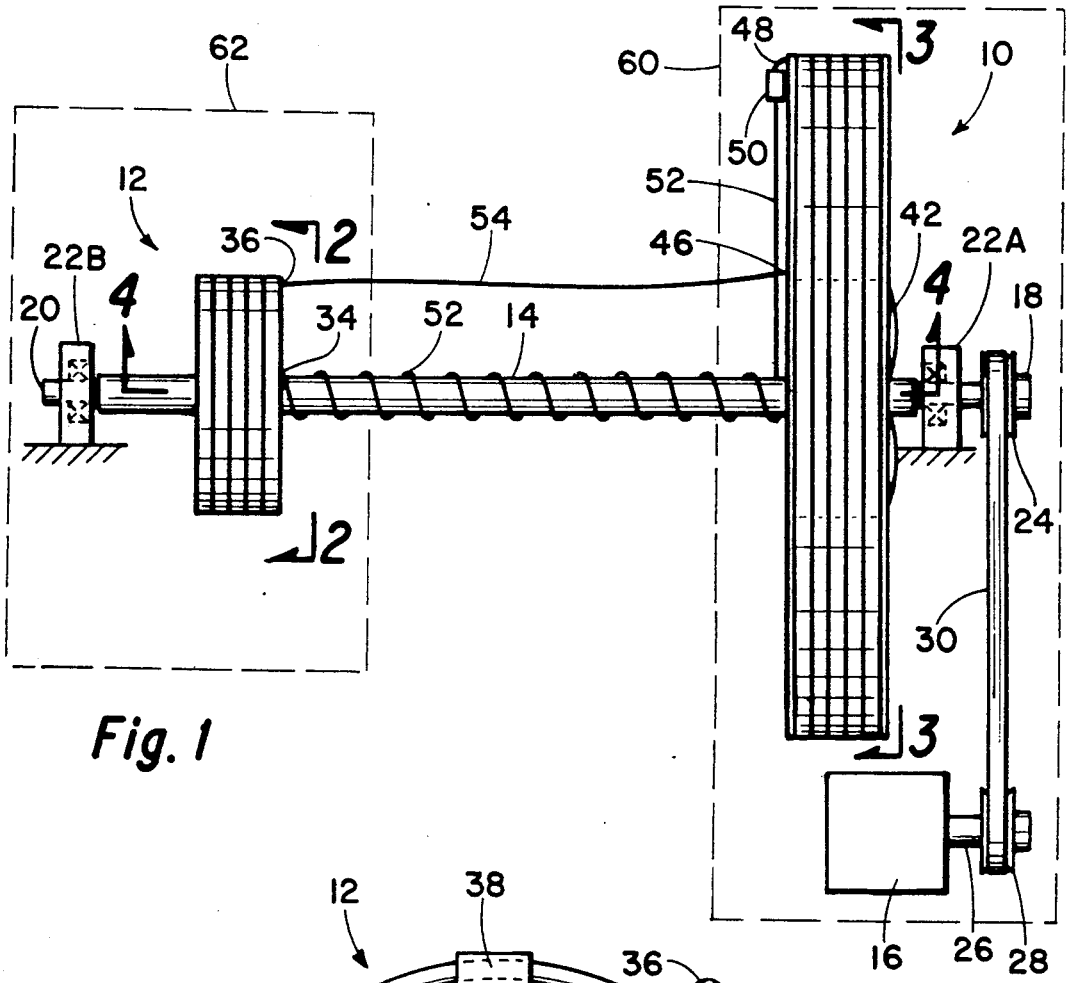

Referring to the drawings and first to FIG. 1, an apparatus which may be employed for practicing the principles of this invention is illustrated and includes as basic components: a condenser unit, generally indicated by the numeral 10; an evaporator unit, generally indicated by the numeral 12; a rotatably shaft 14 on which the condenser unit and evaporator units are mounted; and a prime mover 16 for rotating the shaft and thereby the condenser and evaporator units. Shaft 14 has opposed first end 18 and second end 20. The shaft is supported adjacent its ends by block bearings 22A and 22B. Mounted on shaft 14 adjacent end 18 is a sheave 24. Prime mover 16 has a shaft 26 with a sheave 28 thereon. A belt 30 loops over sheaves 24 and 28 so that prime mover energy is connected to rotate shaft 14. Instead of using sheaves and belts it can be seen that shaft 14 could be connected directly to shaft 26. The prime mover 16 may, by example, be an electric motor, an internal combustion engine, or any other source of providing rotational energy to shaft 14.

Figure 2:
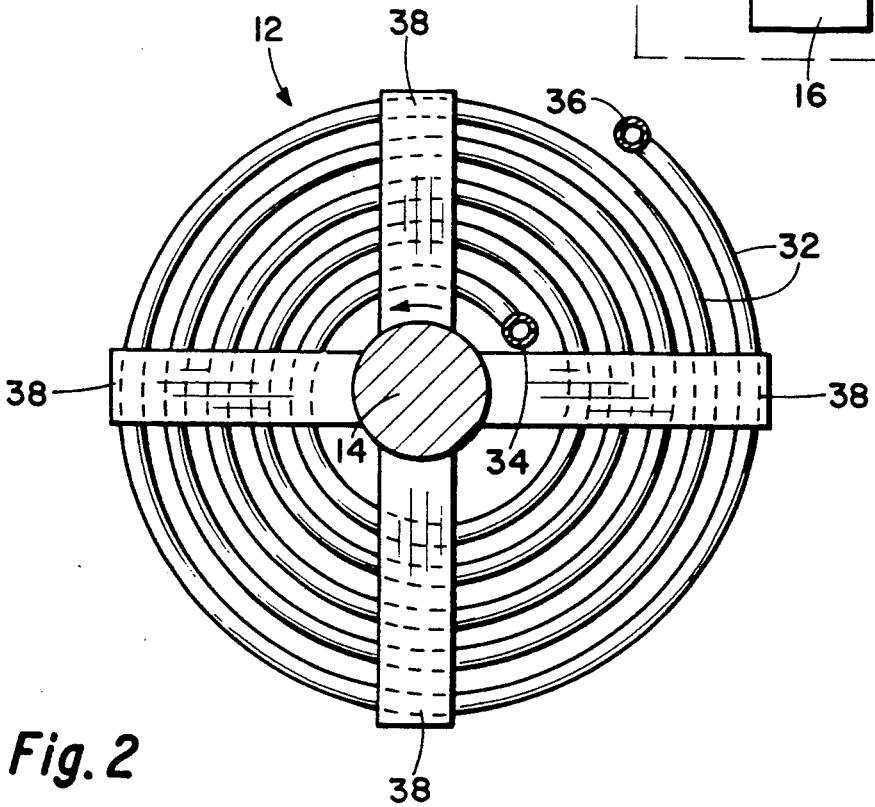
FIG. 2 is an enlarged elevational cross-sectional view as taken along the line 2—2 of FIG. 1 showing the basic coil arrangement of the tubing as employed in the evaporator unit.

FIG. 2 is an elevational cross-sectional view of evaporator unit 12 shown in its elementary arrangement, that is, evaporator unit 12 is formed of a coiled tubular member 32 that is wound about shaft 14. FIG. 2 shows a single coil to illustrate the principle of the centrifugal refrigeration system. The tubular member 32 has an inlet 34 and an outlet 36. The coiled tubular member 32 is supported by radially extending brackets 38 that are representative of any structural device that may be used for supporting the tubular member which is preferably in a plane generally perpendicular to the rotational axis of shaft 14.

Figure 3:
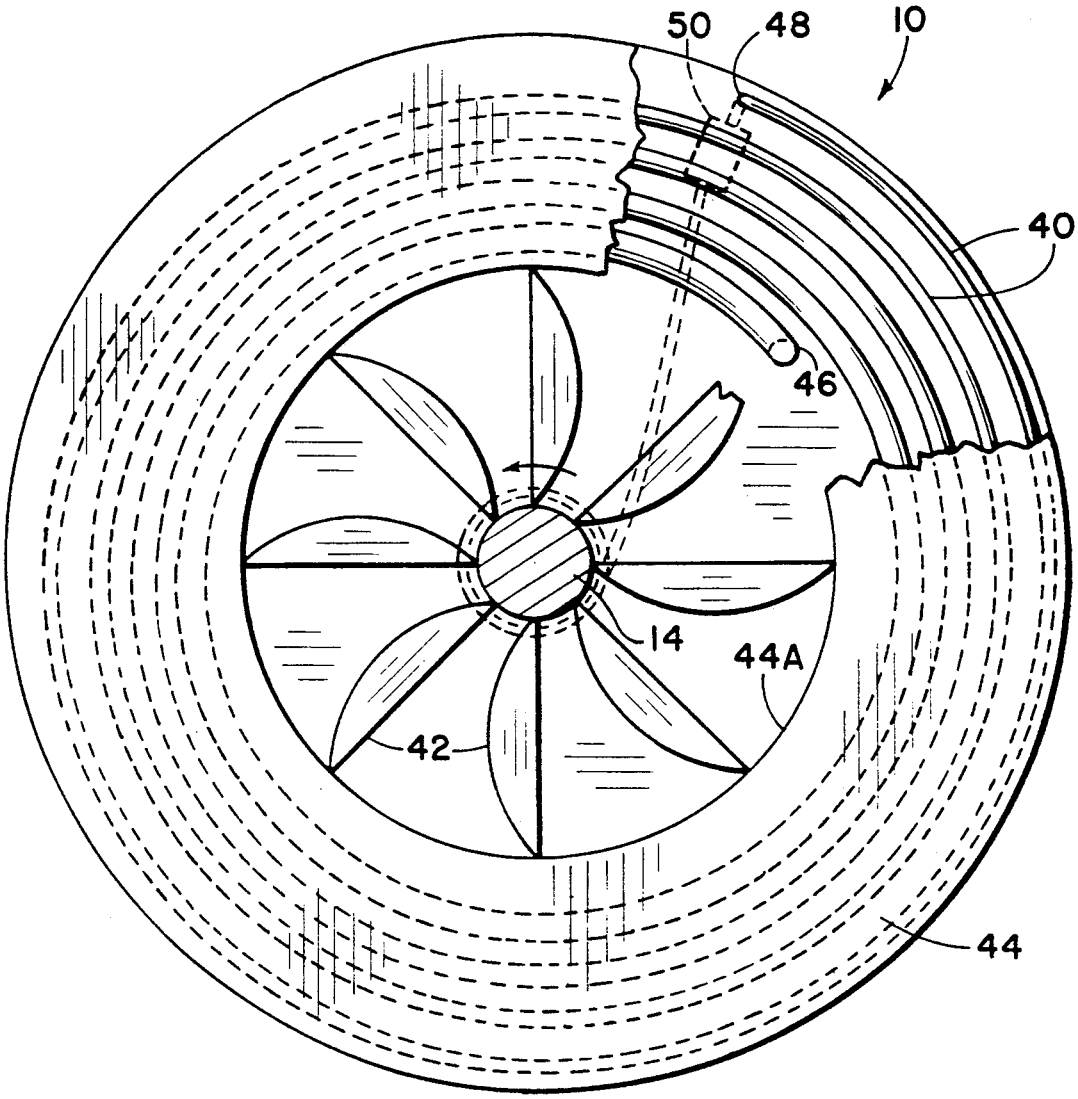
FIG. 3 is an enlarged elevational cross-sectional view as taken along the line 3—3 of FIG. 1 showing the basic arrangement of the condenser unit tubing member as it is coiled about the shaft that supports the condenser unit. Further.

FIG. 3 is an elevational view of the condenser unit showing the fundamental features thereof. The condenser unit is formed of a coiled tubular member 40 supported for rotation about shaft 14, the coiled tubular member being generally in a plane perpendicular to the rotational axis of shaft 14. The coiled tubular member 40 may be supported by a structure that includes fan blades 42 and a plate 44 having an opening 44A therein.

The tubular member 40 of condenser unit 10 has an inlet end 46 and an outlet end 48. In the preferred arrangement the diameter of tubular member 40 decreases in the direction between inlet end 46 and outlet end 48.

Referring again to FIG. 1, a metering device 50 is shown affixed to condenser unit 10 adjacent tubular member outlet end 48. Extending from metering device 50 is a refrigerant delivery tube 52 that connects with evaporator unit inlet 34. Since evaporator unit inlet 34 is adjacent shaft 14 a portion of the refrigerant delivery tube 52 may be wound about the shaft, as illustrated in FIG. 1.

The final item making up the basic centrifugal refrigeration system of FIG. 1 is a refrigerant return tube 54 that connects between the evaporator unit tubular member outlet 36 and the condenser unit tubular member inlet 46.

Figure 4:
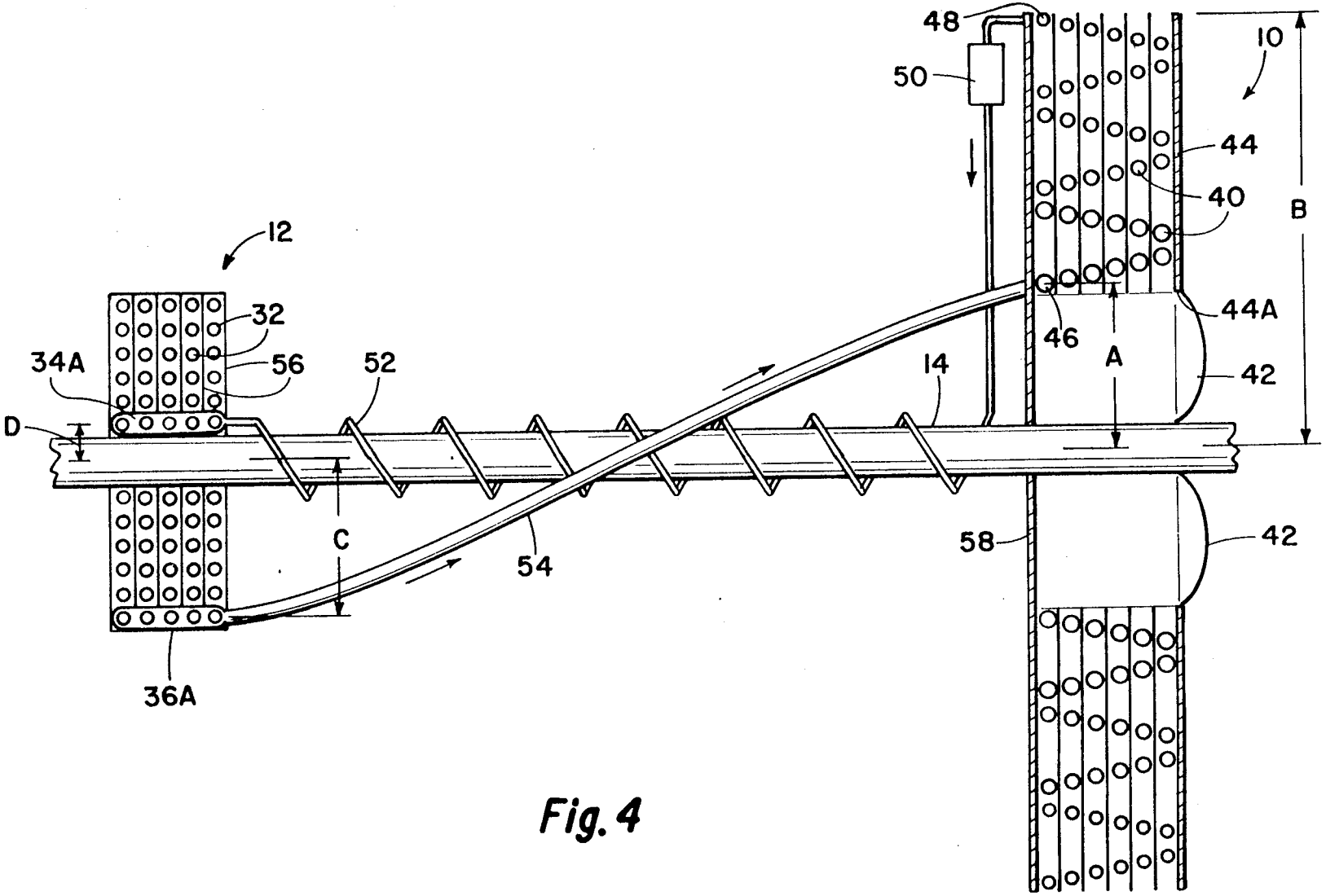
FIG. 4 is an enlarged cross-sectional view taken along the line 4—4 of FIG. 1 showing more details of the construction of the centrifugal refrigeration system and particularly showing the manner in which the tubing member of the condenser unit is interconnected with the tubing member of the evaporator unit.

The basic concepts of the disclosure having been illustrated and described with reference to FIGS. 1, 2 and 3, reference will now be had to FIG. 4 which shows a more preferred embodiment in somewhat greater detail with only the intermediate portion of shaft 14 being shown. The evaporator unit 12 in FIG. 4 is formed of five coils in closely spaced parallel planes that are supported by plate member 56 that may be highly perforated so as to allow free passage of air therethrough. Inlet 34A is an elongated member so as to connect each of the coils of tubular member 32 in parallel and in like manner, outlet 36A connects all of the coils in parallel. The inlet 34A is connected to the refrigerant delivery tube 52, while outlet 36A is connected, as previously described, to the refrigerant return tube 54. Thus, in FIG. 4 the evaporator unit 12 is in the form of a plurality of spirals of tubing in parallel planes, each of the spirals being in planes perpendicular to the rotational axis of shaft 14.

The condenser unit 10 in FIG. 4 is formed of a single tubular spiral, however, the spiral is in multiple adjacent parallel planes and, as described with reference to FIG. 3, tubular member 40 is preferably of decreasing diameter from inlet end 46 to outlet end 48. A radial plate 58 extending from shaft 14 assists in supporting spiral tubular member 40.

FIG. 4 is exemplary of the fact that the arrangement of the condenser unit 10 and evaporator unit 12 may vary while keeping within the principles of this invention.

As noted in FIG. 4, the spiraled tubular member 40; of the condenser unit extends from a radius "A" from the axis of rotation of shaft 14 to a maximum radius "B", that is, inlet end 46 of the condenser unit spiral tubing 40 is at radius "A" and the outlet end 48 at radius "B". The evaporator unit outlet 36A is at a radius "C" from the rotational axis of shaft 14 while the inlet end is at a short radius "D" with respect to shaft 14. In the preferred operation of the centrifugal refrigeration system, radius "C" is less than or at least not substantially greater than radiuses "A" so that the radius increase in ascending order from "D" to "C" to "A" and to "B". This relationship of diameters provides improved compression of the refrigerant as the system is rotated to thereby achieve more effective refrigeration.

OPERATION OF THE CENTRIFUGAL REFRIGERATION SYSTEM

The system as described is completely closed by interconnecting tubular members 32, 40, 52 and 54 with a metering device 50 within the closed system. The metering device 50; is in the form of an orifice and preferably of the type that has no parts which move one against another. The entire closed system is filled with a refrigerant under a selected pressure so that the refrigerant is transformable within the system from a liquid phase to a vapor phase.

To produce a refrigeration effect prime mover 16 is actuated to rotate shaft 14. The shaft is rotated in the counterclockwise direction, as taken with respect to FIGS. 2 and 3 as indicate by the arrows. Within the condenser unit, fluid refrigerant is forced by centrifugal force and the effect of inertia to flow in the tubing in a spiralled radially outwardly migrating path so that fluid and gas in the system are compressed as they migrate outwardly to the reduced diameter tubing toward outlet point 48. The compressed refrigerant passes through metering device 50 as indicated by the arrows in FIG. 4, where the refrigerant is, by the effect of the reduced pressure, converted to a vapor phase in evaporator unit 12. In evaporator unit 12 the refrigerant is transformed back into a gas. The gas is returned from the evaporator to the condenser by way of the refrigerant return tube 54.

Thus, the refrigerant flows in a continuous cycle. As the refrigerant is compressed and transformed from primarily a vapor to a liquid phase within the condenser unit, heat is generated. The area encompassing the condenser unit is indicated by dash line 60 in FIG. 1. If the system is to be used, such as for refrigeration, wherein heat is to be dissipated to the environment, and specifically to the atmosphere, area 60 is connected with the atmosphere so that area 60 may be in a duct work in which air is passed back to the atmosphere carrying heat away from condenser unit 10. The expansion of refrigerant within evaporator unit 12 absorbs heat, that is, it produces a cooling effect and therefor area 62 in which the evaporator unit is housed can be a refrigerator, cold storage, interior of an automobile or interior of duct work used to convey air which is circulated for cooling the interior of a building. Thus the system produces heating in area 60 and cooling in area 62. The system can be used to produce a choice of heating or cooling by switching air flow from either space 60 or space 62 so that the system can function as a heat pump.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved centrifugal refrigeration system comprising:

an elongated rotatably supported shaft having opposed first and second ends and having an axis of rotation;

means to rotate said shaft;

a condenser unit affixed to said shaft adjacent said shaft first end and rotated with said shaft, the condenser unit having a tubing member coiled about said shaft in a path beginning at a condenser unit inlet point at a selected radius "A" from the axis of rotation of said shaft and increasing as it is coiled about said shaft to a condenser unit outlet point at a radius "B" from said shaft axis of rotation;

an evaporator unit affixed to said shaft adjacent said shaft second end and rotated with said shaft, the evaporator having a tubing member coiled about said shaft in a path beginning with an evaporator unit inlet point at a selected radius "D" from the axis of rotation of said shaft and decreasing as it is coiled about said shaft to an evaporator unit outlet point at a radius "C" from said shaft axis of rotation and wherein "C" is less than or at least not substantially greater than "A";

a refrigerant return tube connecting said evaporator unit outlet point to said condenser inlet point;

a refrigerant delivery tube connecting said condenser unit outlet point to said evaporator unit inlet point;

a metering device interposed in said refrigerant delivery tube; and refrigerant filling said condenser tubing, said evaporator tubing, said refrigerant return tube and said refrigerant delivery tube in a closed, hermetically sealed system.

2. An improved centrifugal refrigeration system according to claim 1 including:

fan means affixed to said shaft and configured to pass air through said condenser unit coil as said shaft is rotated.

3. An improved centrifugal refrigeration system according to claim 1 wherein said condenser unit tubing member is arranged in a continuously increased radial spacing from said shaft from said inlet point to said outlet point.

4. An improved centrifugal refrigeration system according to claim 1 wherein said condenser unit tubing member is coiled around said shaft from said inlet to said outlet point in the direction opposite the direction of rotation of said shaft.

5. An improved centrifugal refrigeration system according to claim 1 wherein said evaporator unit tubular member is coiled around said shaft from said inlet to said outlet point in the direction opposite the direction of rotation of said shaft.

6. An improved centrifugal refrigeration system according to claim 1 wherein said condenser unit tubing member is arranged in a plurality of layers of coils in paralleled planes perpendicular to said shaft axis of rotation.

7. An improved centrifugal refrigeration system according to claim 1 wherein said evaporator tubing member is in the form of a plurality of separate evaporator unit coils of tubing, the evaporator unit coils having a common inlet point and common outlet point, the evaporator unit coils being thereby connected in paralleled flow path arrangement.

8. An improved centrifugal refrigeration system according to claim 1 wherein said metering device is positioned in close proximity to said condenser outlet point.

9. An improved centrifugal refrigeration system according to claim 1 wherein said condenser unit tubing member is decreased in internal diameter adjacent said condenser unit outlet point.

* * * * *